US009322329B2

(12) United States Patent
Gegg et al.

(10) Patent No.: US 9,322,329 B2
(45) Date of Patent: Apr. 26, 2016

(54) METHOD FOR SWITCHING OFF A ROTATIONAL SPEED LIMIT IN AN INTERNAL COMBUSTION ENGINE

(71) Applicant: Andreas Stihl AG & Co. KG, Waiblingen (DE)

(72) Inventors: Tim Gegg, Remseck (DE); Armin Koelmel, Rottenburg (DE); Manuel Dangelmaier, Plochingen (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 226 days.

(21) Appl. No.: 13/956,088

(22) Filed: Jul. 31, 2013

(65) Prior Publication Data

US 2014/0034011 A1 Feb. 6, 2014

(30) Foreign Application Priority Data

Jul. 31, 2012 (DE) ..... 10 2012 015 034

(51) Int. Cl.
*F02B 63/02* (2006.01)
*F02D 31/00* (2006.01)

(52) U.S. Cl.
CPC ..... *F02B 63/02* (2013.01); *F02D 31/009* (2013.01)

(58) Field of Classification Search
CPC ..... F02B 63/02; F02D 31/009; F02D 37/02; F02D 41/06; F02P 5/1506; F02P 5/1508; F02N 11/087
USPC ..... 123/339.1, 339.14, 350, 399, 406.12, 123/406.18, 406.23, 406.24, 406.53, 123/406.54, 179.3, 179.5, 179.18, 179.28
See application file for complete search history.

(56) References Cited

U.S. PATENT DOCUMENTS

| | | | | |
|---|---|---|---|---|
| 4,630,590 | A | 12/1986 | Kondo et al. | |
| 7,171,942 | B2 * | 2/2007 | Nickel | 123/335 |
| 7,699,039 | B2 | 4/2010 | Carlsson et al. | |
| 2009/0193669 | A1 | 8/2009 | Gorenflo | |

FOREIGN PATENT DOCUMENTS

WO 2009/085006 A1 7/2009

* cited by examiner

*Primary Examiner* — Hai Huynh
(74) *Attorney, Agent, or Firm* — Walter Ottesen, P.A.

(57) ABSTRACT

A method controls the rpm of a combustion engine in a hand-held work apparatus such as a brushcutter. The engine drives a work tool via a clutch which engages as a function of the engine rpm (n). A spark plug is arranged in the combustion chamber and is driven by an ignition unit. During start of the engine, an rpm lock circuit is active and defines a control variable as a function of the instantaneous rpm ($n_{act}$) of the engine. According to the magnitude of this control variable, operating parameters of the engine are adapted to change the instantaneous rpm ($n_{act}$). A control variable is determined for the adaptation of the operating parameters by the rpm lock circuit. The switch-off of the rpm lock circuit is provided when the control variable of the control lies outside a predetermined bandwidth of the absolute magnitude of the control variables.

18 Claims, 6 Drawing Sheets

METHOD FOR SWITCHING OFF A ROTATIONAL SPEED LIMIT IN AN INTERNAL COMBUSTION ENGINE

CROSS REFERENCE TO RELATED APPLICATION

This application claims priority of German patent application no. 10 2012 015 034.2, filed Jul. 31, 2012, the entire content of which is incorporated herein by reference.

BACKGROUND OF THE INVENTION

U.S. Pat. No. 7,699,039 B2 has disclosed a method for switching off a two-stroke engine as soon as the two-stroke engine has achieved stable idling after starting. A rotational speed or rpm lock circuit is active during the start of the internal combustion engine and is deactivated only when the rpm lock circuit has been able to lower the rotational speed of the internal combustion engine below a deactivation rotational speed. This requires a certain time period, within which the user has to give the rpm lock circuit the opportunity to undershoot the deactivation threshold. If the user intervenes in the regulating process by prematurely opening the throttle, the rpm lock circuit remains active and the user cannot increase the rotational speed (rpm) to a working rotational speed.

SUMMARY OF THE INVENTION

It is an object of the invention to provide a method for switching off rotational speed (rpm) limit in an internal combustion engine.

The invention is based on specifying switch-off criteria for the rpm lock circuit for a method, which ensure operationally appropriate, targeted switching off of the rpm lock circuit irrespective of the intervention of the user.

The rpm lock circuit defines a control variable of the regulation as a function of the instantaneous rotational speed of the internal combustion engine. According to the magnitude of this control variable, operating parameters of the internal combustion engine are adapted in order to change the instantaneous rotational speed. According to the invention, the rpm lock circuit is switched off when the control variable of the regulation, which control variable is defined by the rpm lock circuit for adapting the operating parameters, lies outside a predetermined range of the absolute magnitude of the control variables.

The control variable therefore serves not only, in the context of the regulating loop of the rpm lock circuit, for regulating the instantaneous rotational speed itself to a limit rotational speed below the engaging rotational speed, but also according to the invention, moreover, as a criterion for switching off the rpm lock circuit itself.

After a start of the internal combustion engine, if the starting device is switched off and no further intervention is carried out by the user, machine-typical idling which can also be called natural idling will be set as a steady state after a defined number of crankshaft revolutions. The natural idling lies below the engaging rotational speed or the limit rotational speed of the rpm lock circuit, with the result that the control variable of the rpm lock circuit drops below a minimum limit value. If the control variable has dropped below said limit value, this is a sign that natural idling has been set and the rpm lock circuit does not have to intervene further, that is, can be switched off, advantageously after a defined number of further crankshaft revolutions or after a timing element has elapsed.

If, after the start of the internal combustion engine, the user intervenes in the internal combustion engine, with the result that natural idling cannot be set, the rpm lock circuit will stipulate a magnitude for the control variables, which magnitude forces a setting of the rotational speed below the engaging rotational speed or below a limit rotational speed. If the user sets full throttle, although natural idling had not yet been set, the control variable of the regulation will rise above a maximum limit value, from which the conclusion can be drawn that there is an increase in the rotational speed which is forced by the user. Exceeding of an absolute maximum magnitude of the control variables therefore leads according to the invention to switching off of the rpm lock circuit, advantageously after a defined number of further crankshaft revolutions or after a timing element has elapsed.

According to the invention, it is therefore unremarkable whether, at the start of the internal combustion engine, the user accelerates immediately from the start, in order to start working, or first of all waits for natural idling of the machine before he/she increases the rotational speed of the internal combustion engine to a working rotational speed. Since the switch-off criterion of the rpm lock circuit is the control variable which is defined by said rpm lock circuit in the regulating loop, that is to say a control variable or an actuating variable of the regulating loop, the user can start working with the work apparatus immediately after the start of the internal combustion engine without impairment by the rpm lock circuit and can increase the instantaneous rotational speed above the engaging rotational speed.

For the decision as to whether the rpm lock circuit is switched off or not, the absolute value of the control variables is compared with a lower limit value and/or with an upper limit value, which limit values are predetermined for the selected control variable. Undershooting of the lower limit value indicates natural idling; exceeding of the upper limit value indicates intentional acceleration by the user. The teaching of the invention is therefore already implemented when only one limit value is exceeded or undershot.

In one refinement of the invention, the control variable of the regulation of the rpm lock circuit can be the control variable of the regulating loop itself. For example, the air quantity which is fed to the internal combustion engine, the fuel quantity which is fed to the internal combustion engine, the ignition time point or else the off-cycle ratio of the ignition can be utilized as control variable.

As an alternative, the actuating variable of the regulating loop can also be used as control variable, that is to say the variable which is set directly at the internal combustion engine. If, for example, the fuel supply is controlled by a fuel valve, the actuating variable is the opening time of the fuel valve. The number of crankshaft revolutions which follow one another with one ignition can also be an actuating variable, that is to say the rpm lock circuit stipulates, in order to set the instantaneous rotational speed, in which crankshaft revolutions ignition is carried out and in which crankshaft revolutions ignition is not carried out, that is to say what off-cycle ratio is to be set. As an alternative, the actuating variable can also be the ignition time point itself or else the magnitude of the ignition time point shift itself.

In a further, independent solution of the problem, it is provided that the rpm lock circuit changes the ignition time point of the spark plug, as a result of which the instantaneous rotational speed of the internal combustion engine is regulated. During each revolution of the crankshaft, the ignition time point which is set by the rpm lock circuit is compared with a predetermined ignition time point and the rpm lock circuit is always switched off when the ignition time point which is set exceeds the predetermined ignition time point. If the predetermined ignition time point lies before the top dead center of the piston, the rpm lock circuit is always switched off when the ignition time point which is set lies earlier than the predetermined ignition time point.

If the predetermined ignition time point lies in the range of a retarded ignition after the top dead center TDC of the piston, the rpm lock circuit is always switched off when the ignition time point which is set lies later than the predetermined ignition time point.

The rpm lock circuit is expediently not switched off until a predetermined time period is exceeded, preferably not until the ignition time point which is set exceeds the predetermined ignition time point over a plurality of revolutions of the crankshaft which follow one another.

It is also expedient to increase a counter by one increment each time the predetermined ignition time point is exceeded, in order not to switch off the rpm lock circuit until a counter limit value is reached.

The predetermined ignition time point for deactivating the rpm lock circuit advantageously lies before the top dead center of the piston, that is, in the range of advanced ignition.

In one development of the invention, the rpm lock circuit defines the control variable as a function of the instantaneous rotational speed of the internal combustion engine; in particular, the control variable is calculated as a function of the difference of the instantaneous rotational speed of the internal combustion engine from a predetermined limit rotational speed.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
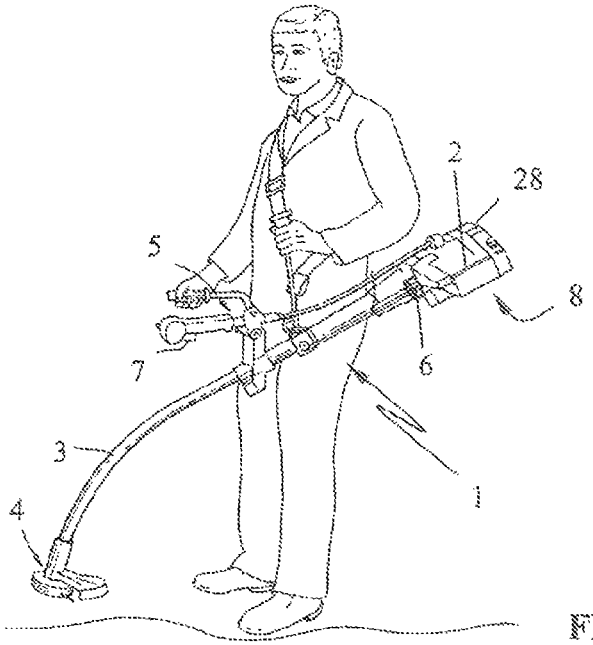
FIG. 1 shows a work apparatus which is hand-held by a user with the work apparatus being a brushcutter by way of example.

The work apparatus 1 which is shown diagrammatically in FIG. 1 is a brushcutter. This hand-held work apparatus 1 is carried by a user and is an example for other portable, hand-held work apparatus, such as cutoff machines, hedge trimmers, power saws, pole pruners, blower devices or the like.

The work apparatus 1 comprises substantially a guide tube 3 which supports, at one end, an internal combustion engine 8 arranged in a housing 2 and, at the other end, a tool head with a work tool 4. In the embodiment shown, the work tool is a cutting filament. The work tool can also be a knife blade or the like.

A handle bar 5 which lies transversely with respect to the guide tube 3 and is fastened to the latter is provided for holding and guiding the work apparatus. Operator-controlled elements 7 for controlling the internal combustion engine 8, which is provided in the housing 2, are provided on one of the handles of the handle bar 5. The crankshaft of the internal combustion engine 8 drives the work tool 4 via a clutch 6, the clutch 6 preferably being configured as a centrifugal clutch. The centrifugal clutch has an engaging rotational speed; above the engaging rotational speed, a rotationally fixed drive connection is produced between the work tool 4 and the crankshaft of the internal combustion engine 8; below the engaging rotational speed, the drive connection to the crankshaft is interrupted.

The internal combustion engine 8 of the work apparatus 1 is preferably an oil-in-gasoline lubricated internal combustion engine, in particular a single-cylinder two-stroke engine. A configuration as an oil-in-gasoline lubricated four-stroke engine, preferably as a single-cylinder four-stroke engine, can be practical.

Figure 2:
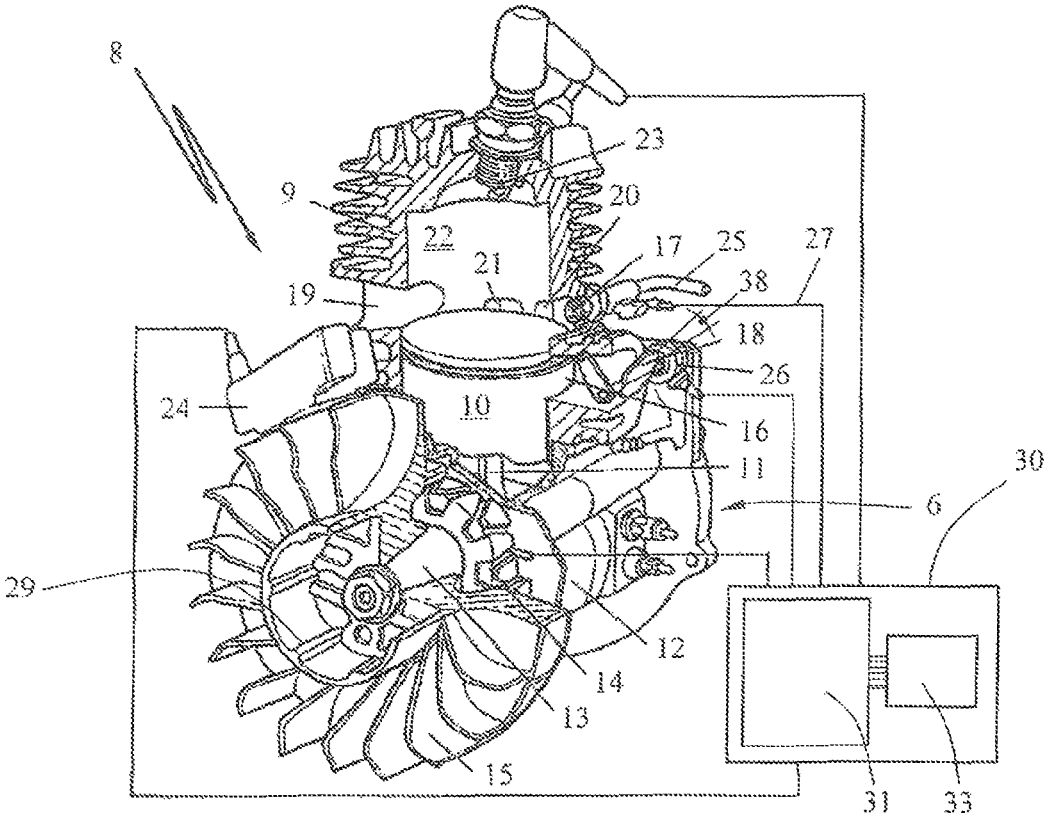
FIG. 2 is a schematic of an internal combustion engine of the work apparatus according to FIG. 1.

FIG. 2 shows an oil-in-gasoline lubricated, single-cylinder two-stroke engine as an example. The internal combustion engine 8 comprises substantially a cylinder 9 and a crankcase 12 wherein the crankshaft 13 is rotatably mounted. A combustion chamber 22 is formed in the cylinder 9 and is delimited by a piston 10 which drives the crankshaft 13 via a connecting rod 11.

A fan wheel 15 for producing a cooling air flow of the air-cooled internal combustion engine 8 is provided at one end of the crankshaft 13. A generator 14 is arranged between the fan wheel 15 and the crankcase 12. The generator 14 provides the electric energy which is necessary for a control unit 30.

Two transfer channels 20 and 21 open into the combustion chamber 22 and are connected to the crankcase 12. The fuel/air mixture is conveyed into the combustion chamber 22 via the transfer channels (20, 21) during the downward stroke of the piston 10. The combustion air, which is necessary for operation, is drawn into the crankcase 12 via an inlet 16 in the region of the top dead center (TDC) of the piston 10, the air supply being controlled by a throttle valve 18. The position of the throttle valve 18 is detected via a position sensor 26 which determines the corresponding rotary angular position of the throttle valve 18 of the control unit 30.

The fuel quantity which is necessary for operation of the internal combustion engine 8 is fed in via a fuel valve 17 which is connected via a fuel line 25 to a fuel reservoir which is preferably at a system pressure. The fuel valve 17 is an electromagnetic fuel valve actuated via a pulsewidth modulated signal. To this end, the fuel valve 17 is connected via a control line 27 to the control unit 30.

The fuel/air mixture is drawn into the combustion chamber 22 and is compressed when the piston 10 moves upward and is ignited via a spark plug 23. The spark plug 23 is driven by an ignition device 24 and the ignition time point of the spark plug 23 can be changed by the control unit 30. After ignition of the fuel/air mixture disposed in the combustion chamber 22 has taken place, the piston 10 moves downward and drives the crankshaft 13 rotationally. When the outlet 19 is open, the combustion gases are discharged via a muffler which is not shown in greater detail.

The control unit 30 comprises an rpm control circuit 31 and an rpm lock circuit 33. By means of the rpm control circuit 31, the ignition time point ZZP of the internal combustion engine 8 is selected such that it is adapted to the rotational speed (rpm) and the load condition of the internal combustion engine 8 in order to ensure high-performance operation of the internal combustion engine.

The internal combustion engine 8 is started manually via a pull-rope starter 28 (FIG. 1). The pull-rope starter 28 acts at the end of the crankshaft 13 whereat the fan wheel 15 is provided. To this end, the fan wheel 15 is configured with an engagement apparatus 29 for the pull-rope starter 28.

The internal combustion engine 8 can be started, electrically or mechanically, in various throttle positions. It is to be ensured here that, during the starting operation, the rotational speed of the internal combustion engine 8 does not rise above the engaging rotational speed of the clutch 6. In order to ensure this, the rpm lock circuit 33 is provided which is active during the start of the internal combustion engine 8 and forces the rotational speed of the internal combustion engine below the engaging rotational speed $n_K$.

Figure 3:
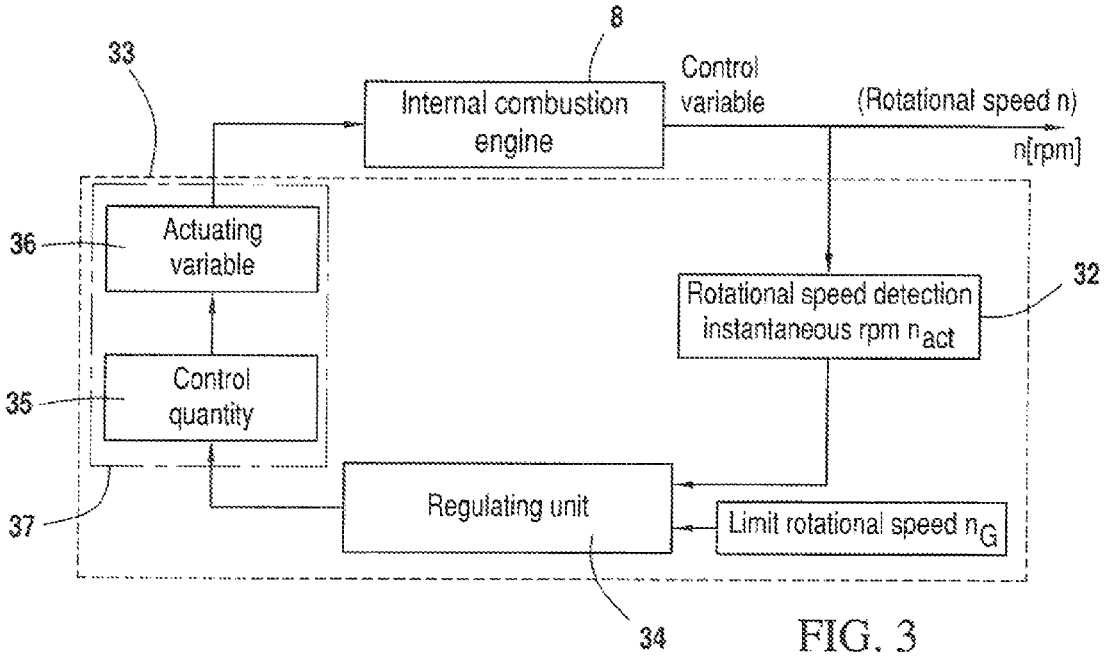
FIG. 3 is a schematic block diagram showing the method of operation of the rpm lock circuit as a control loop.

The method of operation of the rpm lock circuit 33 is represented diagrammatically in FIG. 3. In the case of starting, the internal combustion engine 8 runs up, its rotational speed (n) being detected by a detection unit 32 and being reported to the regulating unit 34 of the rpm lock circuit 33. Furthermore, the regulating unit 34 is fed a limit rotational speed $n_G$ which is preferably smaller than the engaging rotational speed $n_K$. The limit rpm or rotational speed $n_G$ preferably lies approximately 500 rpm below the engaging rotational speed $n_K$.

The regulating unit 34 compares the instantaneous rotational speed $n_{act}$ with the limit rotational speed $n_G$ and, from the difference $\Delta n$, derives a control variable 35 which is converted into an actuating variable 36 and which is applied at the internal combustion engine 8. It is ensured by means of this regulating loop that, during the start of the internal combustion engine 8, the instantaneous rotational speed $n_{act}$ cannot rise above the engaging rotational speed $n_K$ of the clutch 6.

The control variable 35 and the actuating variable 36 of the regulating loop are together called control variable 37. As control variable 35, for example, the air quantity which is fed to the internal combustion engine 8 can be changed. If the regulating unit 34 has defined the control variable "air quantity", an actuating variable 36 is determined which can be, for example, the magnitude of the rotary angle 38 (FIG. 2) of the throttle valve 18 in the inlet 16 of the internal combustion engine 8. The actuating variable 36 which corresponds to the control variable 35, that is, the rotary angle 38 of the throttle valve 18, is defined and is set at the internal combustion engine 8, for example via a stepping motor or the like.

In one embodiment of the invention, it can also be provided to use the ignition time point ZZP as actuating variable 36, that is, to change the rotational speed and power output of the internal combustion engine by virtue of the fact that the time point of the ignition spark at the spark plug 23 is selected relative to the top dead center position (TDC) of the piston 10. The regulating unit 34 defines a change in the ignition time point ZZP as control variable 35 as a function of the difference between the instantaneous rotational speed $n_{act}$ and the limit rotational speed $n_G$. The control variable 35 is used in the rotational speed control circuit 31, in order to adjust the ignition time point ZZP of the internal combustion engine 8 in accordance with the actuating variable 36, calculated from the control variable 35.

Figure 4:
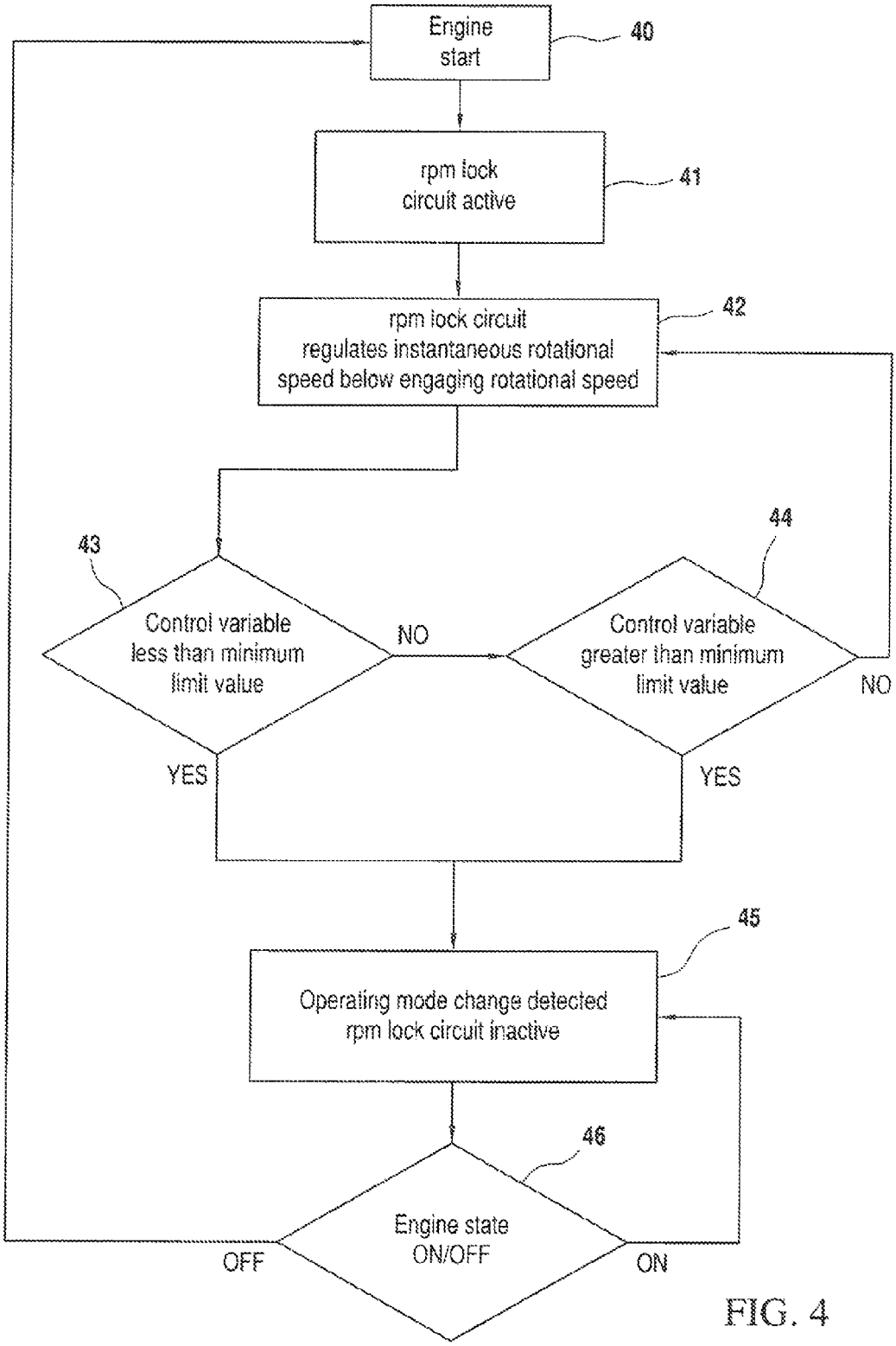
FIG. 4 is a flow chart of the method according to the invention.

Since the rpm lock circuit 33 is active from the start of the internal combustion engine 8 and reliably keeps the rotational speed during the starting operation below the engaging rotational speed $n_K$, a criterion is required, according to which the rpm lock circuit 33 can be switched off, that is, can be switched to inactive. In FIG. 4, a flow diagram is shown for switching off the rpm lock circuit 33 after the start of the internal combustion engine 8.

During the engine start 40, the rpm lock circuit is active, as specified in box 41. The rpm lock circuit 33 regulates the instantaneous rotational speed $n_{act}$ below the engaging rotational speed $n_K$, as specified in field 42.

Each time that the rpm lock circuit 33 has defined the control variable 37 as regulating variable, a check is made as to whether the control variable 37 lies outside a predetermined range of the absolute magnitude of the control variables 37. Here, the range is defined by a lower limit value $G_{min}$ and an upper limit value $G_{max}$. In a first decision diamond 43, a check is made as to whether the control variable 37 which is defined by the rpm lock circuit 33 is less than the lower limit value $G_{min}$. If this is not the case, the defined control variable 37 is compared with the upper limit value $G_{max}$. If the control variable 37 is not greater than the upper limit value $G_{max}$, the second decision diamond 44 branches back to field 42; the rpm lock circuit regulates within the permissible range of the control variables 37.

If the absolute magnitude of the control variable 37 lies below the lower limit value $G_{min}$ or above a maximum limit value $G_{max}$, the decision diamonds 43 and 44 branch to field 45, via which the rpm lock, circuit 33 is switched to inactive. Here, it is assumed that the magnitude of the control variables 37 of the regulating loop of the rpm lock circuit 33 permits a conclusion about operating state changes of the internal combustion engine 8. If the intervention of the regulating loop of the rpm lock circuit 33 can scarcely still be detected, that is, the control variable 37 is very small and lies below the lower limit value $G_{min}$, the internal combustion engine 8 is in natural idling. From the natural idling, an increase in the rotational speed is expected only when the user applies the throttle, that is, deliberately increases the rotational speed of the internal combustion engine 8. It is therefore justified during natural idling to switch the rpm lock circuit 33 to inactive.

If in contrast, the control variable 37 is very large, that is to say the decision diamond 44 branches with YES, the control variable 37 is considerably greater than the upper limit value $G_{max}$; it can be concluded from this that the user is clearly selecting full throttle and desires an increase in the rotational speed (n) beyond the engaging rotational speed $n_K$. The branch into field 45 can also be followed in this state and the rpm lock circuit 33 can be switched off.

Field 45 branches into a decision diamond 46, in which a check is made as to whether the internal combustion engine 8 is in operation or is switched off. If the internal combustion engine 8 is in operation, a return is made to field 45; if the internal combustion engine 8 is switched off, the decision diamond branches back to engine start 40.

It is therefore provided according to the invention to use the control variable 37 of the regulating loop of the rpm lock circuit 33, in order to derive a decision about switching off the rpm lock circuit 33 using the magnitude of the control variables 37 (control variable 35 or actuating variable 36) which are defined for a regulation of the rotational speed.

Figure 5:
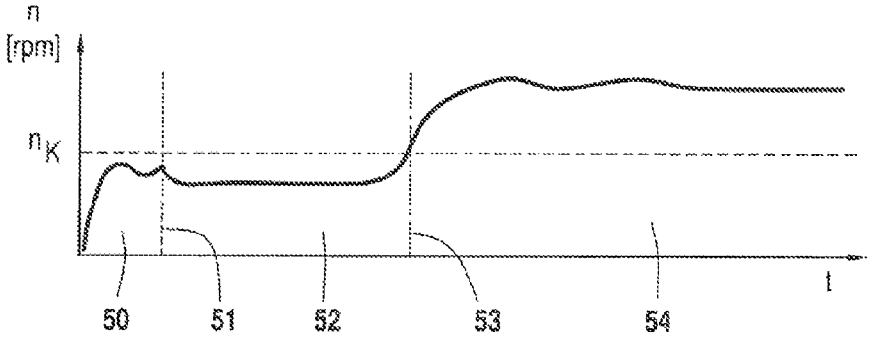
FIG. 5 is a diagram of the rpm plotted as a function of time for the starting operation of an internal combustion engine during idling.

In FIG. 5, the rotational speed profile during the start of an internal combustion engine 8 is shown. In section 50, the internal combustion engine 8 has run out after starting by the pull cord starter 28 and is kept below the engaging rotational speed $n_K$ by the rpm lock circuit 33; the rpm lock circuit 33 is active. The dotted line 51 indicates the deactivation of the rpm lock circuit 33. A state which allows idling conditions to be assumed was detected, using the monitoring of the control variables 37 of the regulating loop of the rpm lock circuit 33. Natural idling has therefore been set in section 52. The user applies the throttle at the level of the dash-dotted line 53, for which reason the rotational speed rises above the engaging rotational speed $n_K$ and the work apparatus 1 is used in the full load range 54 with engaged clutch 6.

Figure 6:
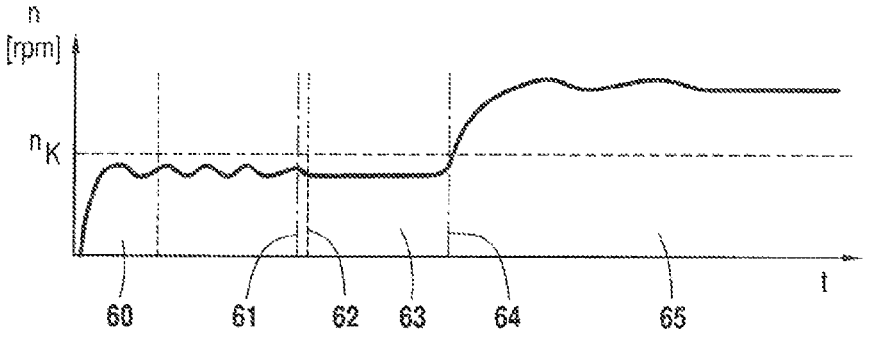
FIG. 6 is a diagram of the rpm plotted as a function of time for a starting operation of the internal combustion engine at full load.

In FIG. 6, the internal combustion engine 8 is started under load, as the fluctuating rotational speed (n) below the engaging rotational speed $n_K$ in section 60 shows. At the level of the dash-dotted line 61, the start enrichment is switched off, the rotational speed drops, and the rpm look circuit 33 reduces its intervention; the control variable 37 becomes smaller and undershoots the lower limit value $G_{min}$, for which reason the rpm lock circuit 33 is switched off at the level of the dotted line 62. Natural idling has been set in section 63. At the level of the dash-dotted line 64, the user again applies the throttle, the rotational speed $n_{act}$ exceeds the engaging rotational speed $n_K$, the clutch 6 engages, and the work apparatus is in section 65 in the work mode.

In the same way as the ignition time point ZZP, the fuel quantity which is fed to the internal combustion engine 8 can also be regulated as control variable 35 in such a way that the instantaneous rotational speed $n_{act}$ does not rise above the limit rotational speed $n_G$ or the engaging rotational speed $n_K$.

Figure 9:
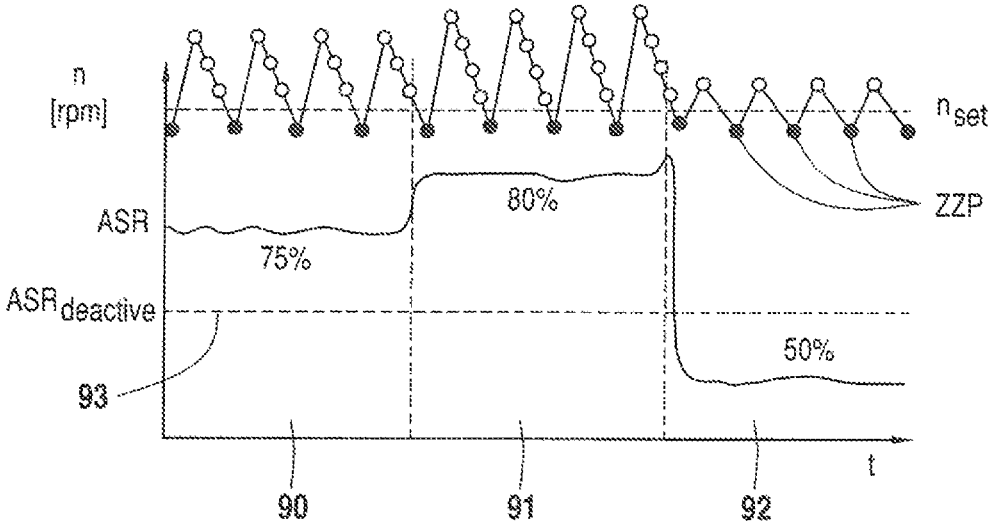
FIG. 9 is a diagram of the rpm plotted as a function of time with off-cycle of the ignition above a rotational speed threshold; and, FIG. 10 is a flow diagram for detecting a combustion pattern.

In a corresponding way, the off-cycle ratio ASR of the ignition can also be used as control variable 35, as is shown at the top in FIG. 9.

Since the actuating variable 36 for intervention at the internal combustion engine 8 is derived from the control variable 35, the actuating variable 36 itself can also be used directly as control variable 36 for switching off the rpm lock circuit 33. If, for example, the control variable 35 was the fuel quantity defined by the regulating unit 34 (FIG. 3), the opening time of the fuel valve 17 (FIG. 2) is derived as actuating variable 36, for example the pulsewidth of the control signal which is fed to the fuel valve 17.

Accordingly, if the ignition time point $ZZP_j$ is selected as control variable 35, the ignition time point $ZZP_i$ itself can be used as actuating variable 36 and can be selected directly. No change of the ignition time point by adjustment therefore takes place, but rather the ignition time point ZZP which is defined by the regulation of the rpm lock circuit 33 is set directly. This can be carried out, for example, via a characteristic diagram, from which the regulating unit 34 (FIG. 3) reads out the ignition time point to be selected which is then set directly at the internal combustion engine 8, independently of which ignition time point $ZZP_i$ was set in the preceding crankshaft revolution.

As an alternative, it can also be practical to evaluate the magnitude of the ignition time point adjustment and to apply it by way of actuating elements to the ignition time point $ZZP_i$ which had already been set for a preceding crankshaft revolution.

Figure 7:
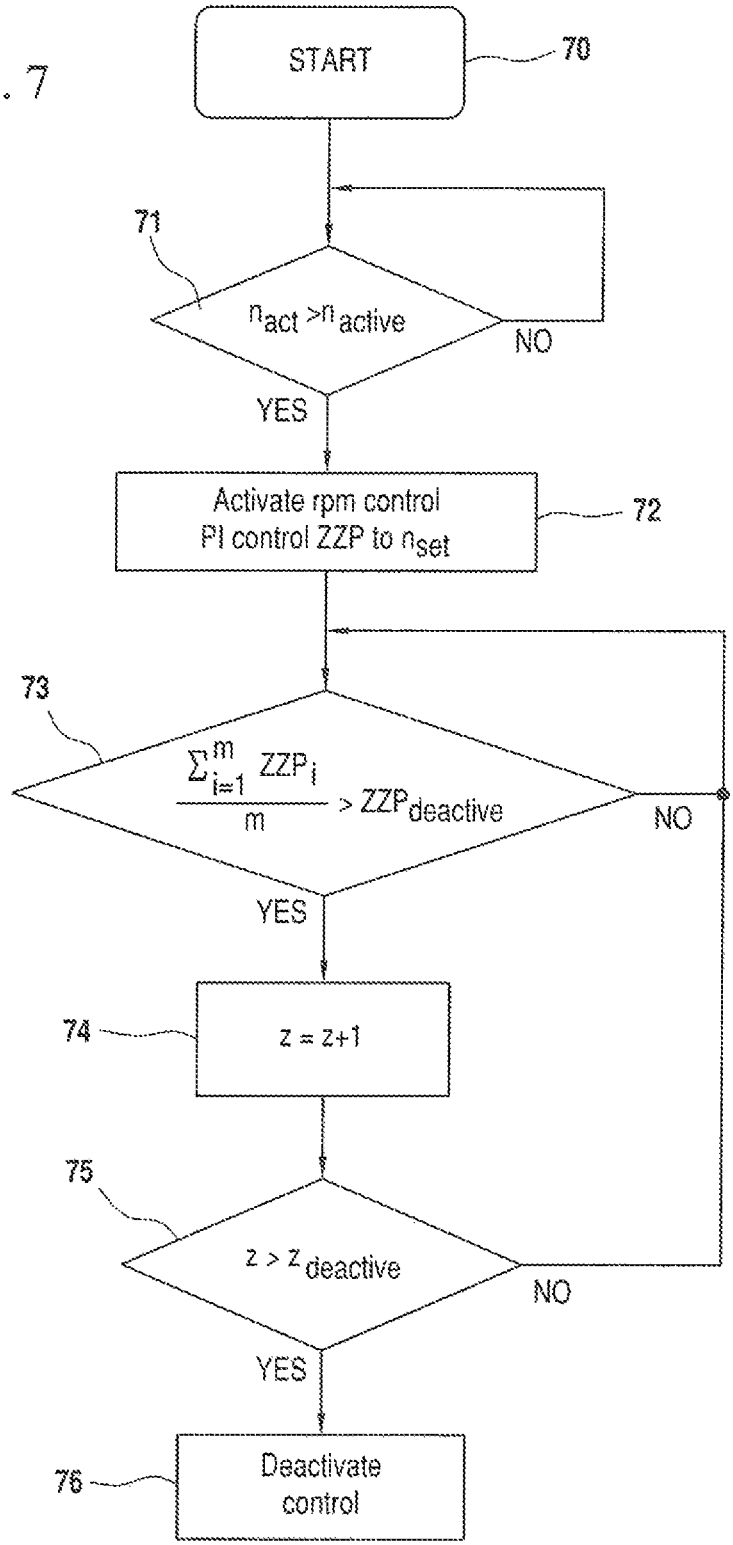
FIG. 7 shows a flow diagram of the sequence of switching off an rpm lock circuit according to a further embodiment of the invention.

In another, independent refinement of the invention, it is provided to perform the switch-off of the rpm lock circuit 33 as a function of the ignition time point $ZZP_i$ itself which is set by the rpm lock circuit 33. To this end, as shown in the flow diagram according to FIG. 7, the engine is started in field 70 and the instantaneous rotational speed $n_{act}$ is compared with an activation rotational speed $n_{active}$. The decision diamond 71 branches downward and activates the rotational speed controller only when the instantaneous rotational speed $n_{act}$ is greater than the activation rotational speed $n_{active}$, by way of which rotational speed controller, for example, the ignition time point is set by a PI regulation in such a way that a setpoint rotational speed $n_{set}$ is achieved. The ignition time point which is set by the rotational speed controller according to field 72 is compared with the ignition time point $ZZP_{deactive}$ in the decision diamond 73, which leads to a deactivation of the rotational speed limit if the ignition time point $ZZP_i$ which is set is greater than the ignition time point $ZZP_{deactive}$ which is predetermined as limit.

It is advantageously provided according to the decision diamond 73 that a plurality of ignition time points $ZZP_i$ which follow one another are summed and a mean value is formed which is then compared with the ignition time point $ZZP_{deactive}$. If the mean value of the ignition time point, which is set of revolutions of the crankshaft which follow one another exceeds the predetermined ignition time point $ZZP_{deactive}$, the decision diamond 73 branches to a counter 74 which counts up by one increment, is increased by one in the present embodiment. If the averaged ignition time point lies below the deactivation threshold of the ignition time point $ZZP_{deactive}$, the decision diamond 73 branches back.

If the counter 74 reaches a limit value $z_{deactive}$, the rpm controller 33 is deactivated in accordance with the decision diamond 75, as shown in field 76. If the counter level (z) lies below $z_{deactive}$, the decision diamond 75 branches back before the decision diamond 73 for forming the mean value of the ignition time point $ZZP_i$.

It has been shown to be practical that satisfactory results are achieved if the ignition time point $ZZP_i$ is averaged over from 2 to 25, preferably over 10 crankshaft revolutions which follow one another. The index (m) is therefore selected to be between 2 and approximately 25.

Figure 8:
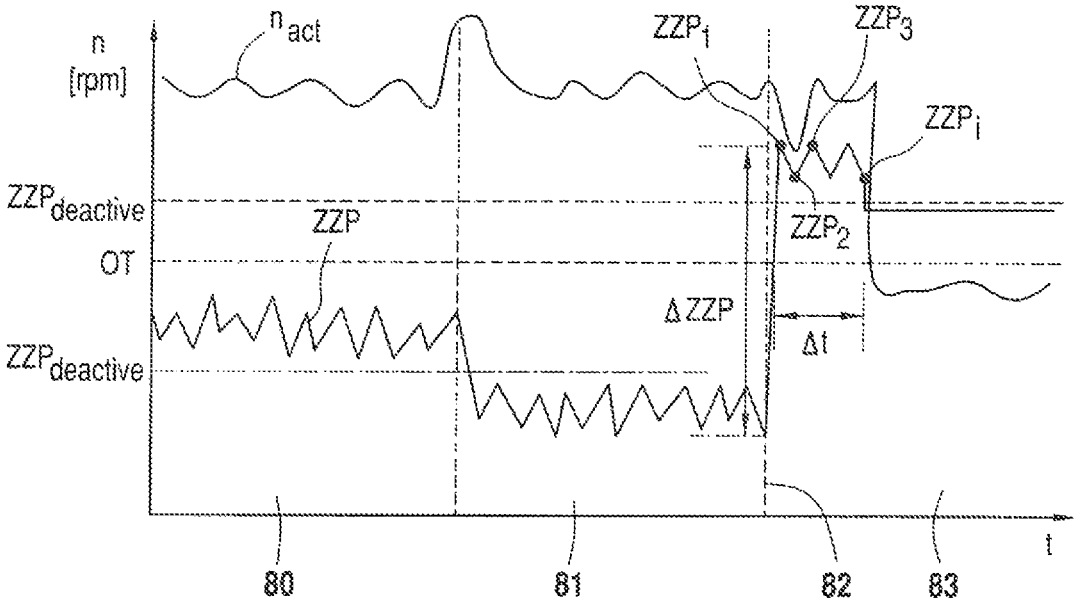
FIG. 8 shows a diagram of the rpm of the internal combustion engine plotted as a function of time of the ignition time points relative to the position of the piston.

As FIG. 8 shows, the start of the internal combustion engine 8 takes place with start throttle in section 80. The ignition time point lies at a very retarded time, at approximately 10° crank angle CA after the top dead center TDC of the piston 10 in the embodiment which is shown. If the user applies more throttle, that is, if the throttle valve 18 is open, fuel/air mixture is fed in increasingly; this leads to a further retardation, adjustment of the ignition time point ZZP to values of from approximately 20° to 25° CA in section 81. The instantaneous rotational speed $n_{act}$ of the internal combustion engine 8 is regulated downward to a pronounced extent via the rpm lock circuit 33. If the load state changes from full load to idling, which is indicated at the dashed line 82, this results in section 83 in a change in the mixture quantity which is fed in, with the result that, in order to maintain the rotational speed, the ignition time point is adjusted, in particular, suddenly from retarded ignition in section 81 to advanced ignition, in section 83. The ignition time point ZZP exceeds the deactivation threshold $ZZP_{deactive}$ of the ignition time point which lies at approximately 5° before top dead center in the embodiment. If the ignition time point $ZZP_i$ remains in the region of advanced adjustment, on the other side of the ignition time point $ZZP_{deactive}$ of the deactivation threshold over a predefinable number of revolutions of the crankshaft, the rpm lock circuit 33 is switched off. Switch-off therefore always takes place when the ignition time point $ZZP_i$ which is set by the rpm lock circuit 33 lies earlier than the predetermined ignition time point $ZZP_{deactive}$. When the rpm lock circuit 33 is switched off, the ignition time point $ZZP_i$ is constant and lies in the region of the predetermined ignition time point $ZZP_{deactive}$ approximately from 3° to 7° CA before top dead center.

The switch-off of the rpm lock circuit 33 advantageously takes place only when the ignition time point $ZZP_i$ lies on the other side of the predetermined ignition time point $ZZP_{deactive}$ in a plurality of crankshaft revolutions which follow one another, that is, the state of advanced ignition prevails over a predetermined time period.

It can expediently be provided that a counter 74 is counted up by one increment each time the predetermined ignition time point $ZZP_{deactive}$ is exceeded, in order then to switch off the rpm lock circuit 33 when a counter limit value $z_{deactive}$ is reached. By way of example, the counter or the counter limit value $z_{deactive}$ also ensures that the rpm lock circuit 33 is not switched off immediately when a switch-off criterion is present, but rather that switch-off of the rpm lock circuit 33 preferably takes place only when the switch-off criterion is present over a predetermined time period Δt (FIG. 8). The time period Δt can be defined in different ways, for example by elapsing of a timing element, by running up of a counter, by a predetermined number of crankshaft revolutions or the like.

The formation of a mean value over the ignition time point $ZZP_i$ of a plurality of crankshaft revolutions which follow one another ensures that outliers are eliminated and natural idling has been set with high certainty in section 83.

For full load detection, it can be practical to also provide switch-off in the case of extreme retarded ignition in a manner which corresponds to the switch-off in the case of advanced ignition; the predetermined ignition time point $ZZP'_{deactive}$ is selected correspondingly, in the region of retarded ignition at from approximately 10° to 12° after the top dead center (TDC) of the piston 10 in the embodiment which is shown according to FIG. 8. The rpm lock circuit 33 is switched off when the ignition time point $ZZP_i$ which is set lies later by one time or multiple times than the predetermined ignition time point $ZZP'_{deactive}$.

In a further independent refinement of the invention, the switch-off of the rpm lock circuit 33 can also take place as a function of the ignition time point shift ΔZZP. If the magnitude of the ignition time point shift ΔZZP lies above a predetermined value, the switch-off of the rpm lock circuit 33 cakes place. Thus, deactivation of the rpm lock circuit 33 can already take place when the jump from retarded ignition to advanced ignition takes place, as is shown in FIG. 8 by way of the double arrow for the ignition time point shift ΔZZP.

In the embodiment according to FIG. 9, the deactivation of the rpm lock circuit 33 is carried out as a function of the off-cycle ratio ASR. Start throttle prevails in the first section 90; ignition is triggered only every fourth crankshaft revolution; the off-cycle ratio ASR lies at 75%.

Full load prevails in the following section 91. The user has increased the throttle from the start throttle, in order to release the start throttle latching. The increased mixture feed leads to an even more pronounced off-cycle; ignition is carried out only every fifth crankshaft revolution; the off-cycle ratio ASR lies at 80%.

During the change from full load from section 91 into idling of section 92, the off-cycle ratio ASR falls significantly from 80% to 50%, that is to say an ignition is triggered during idling every second crankshaft revolution; the off-cycle ratio ASR lies at 50%. In order to switch off an rpm lock circuit 33, the off-cycle ratio ASR can therefore be monitored, in order to switch off the rpm lock circuit 33, if a deactivation threshold 93 is undershot or is exceeded in another context, since natural idling can then be assumed.

Figure 10:
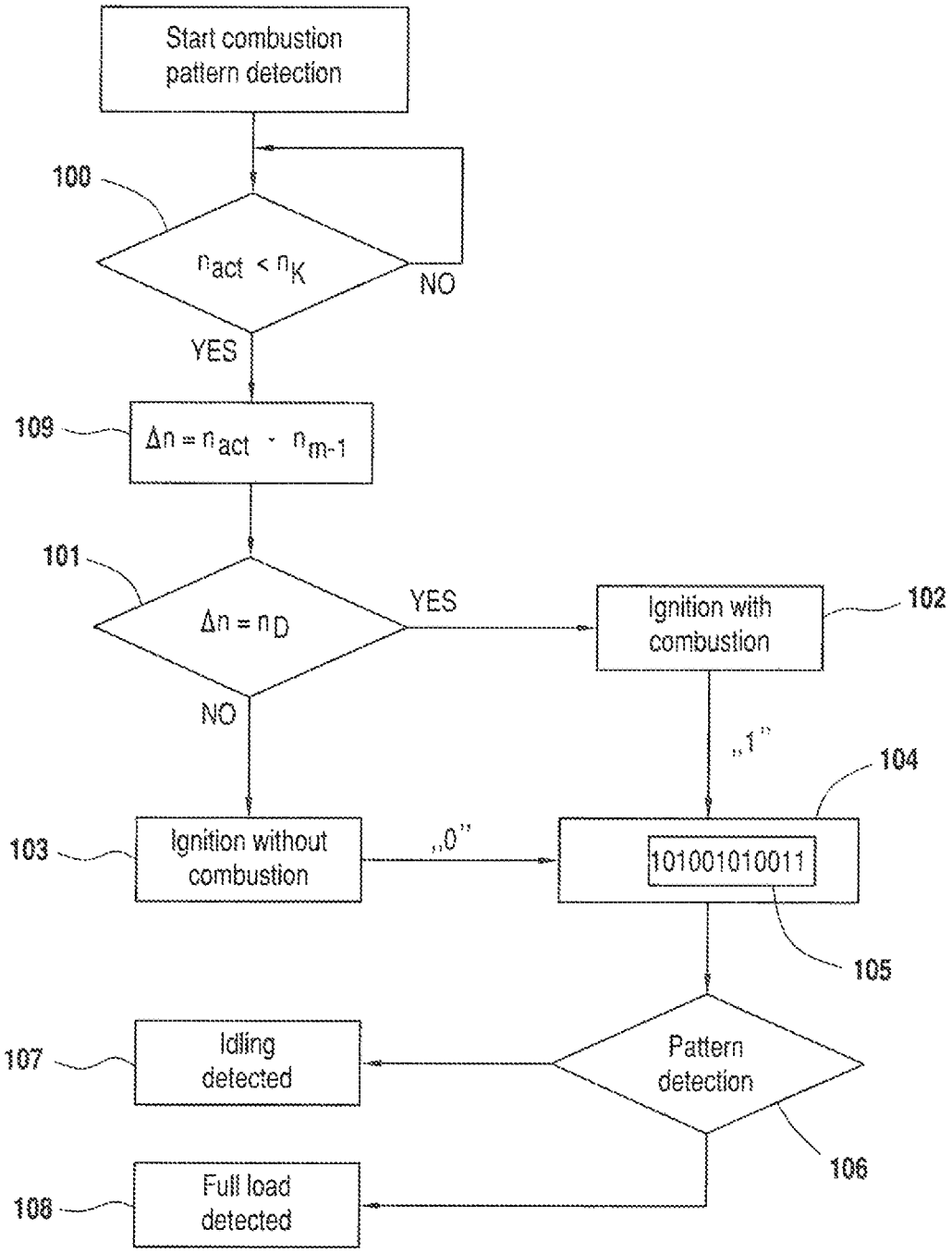

FIG. 10 shows a flow diagram for detecting a combustion pattern. The combustion pattern detection is active only when the instantaneous rotational speed $n_{act}$ lies below the engaging rotational speed $n_K$. The decision diamond 100 is provided accordingly.

If the instantaneous rotational speed $n_{act}$ lies below the engaging rotational speed $n_K$, the rotational speed difference Δn is defined from the instantaneous rotational speed $n_{act}$ and the rotational speed $n_{m-1}$ of the preceding crankshaft rotational speed (field 109). If the determined rotational speed Δn is greater than a predetermined differential value $n_D$, combustion operation is present; the decision diamond 101 branches to the right to the field 102 'Ignition with combustion'.

If Δn lies below the predetermined differential rotational speed $n_D$, no combustion operation has taken place, despite ignition, and the decision diamond 101 branches downward into the field 103 'Ignition without combustion'.

If a combustion operation can be determined, a "1" is input via the field 102 into the shift register 104; if there is no combustion operation, a "0" is fed in via the field 103 into the shift register. In this way, a "0" or a "1" which follow one another as a row is stored in the shift register as a function of combustion operations which have taken place per revolution of the crankshaft.

The content of a window 105 of the shift register 104 is fed to a pattern detection means which detects via the decision diamond 106 in comparison with predetermined patterns whether there is idling or whether there is full load. If the window 105 has, for example, the content 1 0 1 0 0 1 0 1 0 0 1 1 which is shown in FIG. 10, there is an idling combustion sequence; the internal combustion engine is in natural idling. An rpm lock circuit can then be switched off.

If, in contrast, the window 105 shows a row of 1s which follow one another, an ignition and combustion process take place with every revolution of the crankshaft, with the result that a full load combustion sequence can be detected; the internal combustion engine is in full load.

The window 105 is designed in such a way that a predetermined number of crankshaft revolutions which follow one another are detected with or without combustion. In the embodiment which is shown, 13 crankshaft revolutions which follow one another are detected; it can be practical to use more or fewer crankshaft revolutions in order to form a combustion pattern.

The load state of the internal combustion engine 8 can be read off at the outputs (107, 108) of the decision diamond 106 as a function of the pattern detection; a rpm lock circuit can therefore be deactivated as a function of the signals of the outputs (107, 108).

It is understood that the foregoing description is that of the preferred embodiments of the invention and that various changes and modifications may be made thereto without departing from the spirit and scope of the invention as defined in the appended claims.

What is claimed is:

1. A method of controlling the rotational speed of a combustion engine in a handheld work apparatus, wherein the combustion engine is supplied with a fuel/air mixture; the combustion engine has a crankshaft configured to drive a work tool via a clutch configured to engage in dependence upon the rotational speed of the combustion engine; the clutch being configured to generate a drive connection with the crankshaft when above an engaging rotational speed ($n_K$) and to interrupt the drive connection when below the engaging rotational speed ($n_K$); the combustion engine further having a combustion chamber and a spark plug arranged in the combustion chamber; the combustion engine further having an ignition unit for driving the spark plug and an rpm lock circuit configured as a closed-loop control circuit; the rpm lock circuit being further configured to switch on when the combustion engine is started and to set the instantaneous rotational speed ($n_{act}$) of the combustion engine below the engaging rotational speed ($n_K$) of the clutch and, for this purpose, the rpm lock circuit further being configured to change a control variable and adapt operating parameters of the combustion engine in accordance with the value of the control variable to change the instantaneous rotational speed ($n_{act}$); the control variable being a control quantity or a manipulated variable, the method comprising the step of:

switching off the rpm lock circuit when the absolute value of the control variable for adapting the operating parameters drops below a lower limit value ($G_{min}$) or exceeds an upper limit value ($G_{max}$).

2. The method of claim 1, wherein the rpm lock circuit is switched off when the manipulated variable or control quantity of the control loop lies outside a predetermined bandwidth; and, the bandwidth is defined by at least one of an absolute lower limit value ($G_{min}$) and an absolute upper limit value ($G_{max}$).

3. The method of claim 1, wherein the control quantity is the amount of air supplied to the combustion engine.

4. The method of claim 1, wherein the control quantity is the amount of fuel supplied to the combustion engine.

5. The method of claim 1, wherein the control quantity is the ignition time point (ZZP).

6. The method of claim 1, wherein the control quantity is the off-cycle ratio (ASR) of the ignition.

7. The method of claim 1, wherein the fuel metering is controlled by a fuel valve and the actuating variable is the open time of the fuel valve.

8. The method of claim 1, wherein the actuating variable is the number of sequential crankshaft revolutions with an ignition.

9. The method of claim 1, wherein the actuating variable is the absolute ignition time point (ZZP).

10. The method of claim 1, wherein the actuating variable is the magnitude of the ignition time point shift.

11. The method of claim 1, wherein the work apparatus is one of a chain saw, a cutoff machine, a hedge trimmer and a blower.

12. A method for controlling the rotational speed of a combustion engine in a handheld work apparatus, wherein the combustion engine has a combustion chamber delimited by a piston with a fuel/air mixture being metered to the combustion chamber, the combustion engine has a crankshaft configured to drive a work tool via a clutch configured to engage in dependence upon the rotational speed (n) of the combustion engine; the clutch being configured to generate a drive connection with the crankshaft when above an engaging rotational speed ($n_K$) and to interrupt the drive connection when below the engaging rotational speed ($n_K$); the combustion engine further having a spark plug arranged in the combustion chamber; an ignition unit for driving the spark plug so as to cause an ignition spark to be triggered relative to the angular position of the crankshaft; an rpm lock circuit configured as a closed-loop control circuit; the rpm lock circuit being further configured to switch on when the combustion engine is started and to set the instantaneous rotational speed ($n_{act}$) of the combustion engine below the engaging rotational speed ($n_K$) of the clutch; the rpm lock circuit is configured to change the ignition time point (ZZP) of the spark plug to change the instantaneous rotational speed ($n_{act}$) of the combustion engine as a manipulated variable; the method comprising the steps of:

providing a pregiven ignition time point ($ZZP_{deactive}$);

with each rotation of the crankshaft, comparing the ignition time point (ZZP) set by the rpm lock circuit to the pregiven ignition time point ($ZZP_{deactive}$); and, switching off the rpm lock circuit when the set ignition time point (ZZP) exceeds the pregiven ignition time point ($ZZP_{deactive}$) over several sequential revolutions of the crankshaft.

13. The method of claim 12, wherein a counter is increased by one increment when the pregiven ignition time point ($ZZP_{deactive}$) is exceeded and the rpm lock circuit is switched off when a counter limit value ($z_G$) is reached.

14. The method of claim 12, wherein the pregiven ignition time point ($ZZP_{deactive}$) lies ahead of top dead center of the piston.

15. The method of claim 12, wherein the ignition time point ($ZZP_i$) determined by the rpm lock circuit per crankshaft revolution is averaged over several sequential crankshaft revolutions.

16. The method of claim 12, wherein said rpm lock circuit determines a control variable in dependence upon the instantaneous rotational speed ($n_{act}$) of the combustion engine.

17. The method of claim 12, wherein the rpm lock circuit determines a control variable in dependence upon the difference of the instantaneous rotational speed ($n_{act}$) of the combustion engine and a pregiven limit rotational speed ($n_G$).

18. The method of claim 12, wherein the work apparatus is one of a chain saw, a cutoff machine, a hedge trimmer and a blower.

* * * * *

UNITED STATES PATENT AND TRADEMARK OFFICE

CERTIFICATE OF CORRECTION

PATENT NO. : 9,322,329 B2
APPLICATION NO. : 13/956088
DATED : April 26, 2016
INVENTOR(S) : Gegg et al.

It is certified that error appears in the above-identified patent and that said Letters Patent is hereby corrected as shown below:

In the Specification

In column 7:
Line 37: delete "36" and substitute -- 37 -- therefor.
Line 43: delete "$ZZP_j$" and substitute -- $ZZP_i$ -- therefor.

In column 9:
Line 41: delete "cakes" and substitute -- takes -- therefor.

Signed and Sealed this
Second Day of August, 2016

Michelle K. Lee

Michelle K. Lee
*Director of the United States Patent and Trademark Office*